United States Patent [19]

Noellert

[11] 3,965,597

[45] June 29, 1976

[54] ADVERTISING SIGN STRUCTURE

[75] Inventor: Larry L. Noellert, Mount Clemens, Mich.

[73] Assignee: Willey Sign Company, Mount Clemens, Mich.

[22] Filed: Nov. 6, 1974

[21] Appl. No.: 521,353

[52] U.S. Cl. ..... 40/130 D; 40/140

[51] Int. Cl.[2] ..... G09F 13/04

[58] Field of Search ..... 40/140, 130 D, 130 R, 40/130 G, 141, 142 R, 125 E

[56] References Cited

UNITED STATES PATENTS

| | | | |
|---|---|---|---|
| 1,661,531 | 3/1928 | Forger | 40/141 |
| 2,778,134 | 1/1957 | Willey | 40/130 D |
| 2,895,245 | 7/1959 | Spangler | 40/130 D |
| 2,995,848 | 8/1961 | Yetman | 40/130 D |
| 3,404,475 | 10/1968 | Coad | 40/130 D |

*Primary Examiner*—Louis G. Mancene
*Assistant Examiner*—John F. Pitrelli
*Attorney, Agent, or Firm*—Hauke & Patalidis

[57] ABSTRACT

An advertising sign structure made of a single-piece appropriately shaped open shell of plastic material provided with a continuous lateral flange portion disposed intermediate the bottom and top of the shell for fastening to a backing panel, a resilient gasket being disposed between the marginal surface of the backing panel and the flange surface. The surface of the backing panel disposed within the shell may be provided with an appropriate lighting element such as a contoured tubular fluorescent lamp. In normal use the backing panel is attached to an appropriate support structure, such as posts or a building. The structure consisting of the shell with attached backing panel forms the complete advertising sign, or alternatively, forms an element of the sign such as a single letter or a plurality of letters.

6 Claims, 6 Drawing Figures

ADVERTISING SIGN STRUCTURE

BACKGROUND OF THE INVENTION

Free standing lighted advertising signs have recently become of common use. Such signs consist generally of a plurality of free standing letter elements or of a unitary free standing composite sign consisting of several letters, or other characters, or of a trademark representation, or the like, which are mounted on a specially provided supporting structure such as pillars or a tower, or which are attached to the front of a building such as a department store, grocery store, gasoline station or the like.

Such free standing advertising sign structures are made generally of a single-piece relatively shallow open shell of plastic material, preferably translucent, either colorless of of an appropriate color, mounted on a backing panel attached to the edge of the shell open end. The surface of the backing panel disposed towards the interior of the shell often acts as a support means for a luminary such as a fluorescent light tube bent to an appropriate contour. The electrical elements for supplying electrical power to the fluorescent light tube, such as connection boxes, transformers, and the like, are also mounted on the backing panel, generally on the rear face of the panel. Means are also provided, such as brackets and the like with appropriate fasteners, for mounting the backing panel on the supporting structure.

The backing panel has a peripheral contour corresponding to the peripheral shape of the molded shell and is attached to the edge of the shell open end by means of complex and costly intermediary fastening elements. The means provided for attaching the shell to the backing panel must permit, without destroying the ornamental value of the structure, a relatively easy disassembly of the shell and the backing panel for gaining access to the interior of the shell for maintenance, repair, or replacement of the electrical equipment and luminary. Furthermore, as the advertising sign structure is generally erected on the outside in an un-sheltered location, it is subjected to all sorts of adverse weather conditions such as wind, rain, snow, high temperature, low temperature, and the like. The structure must, therefore, be substantially weatherproof, and the interior of the shell containing relatively fragile electrical equipment and luminaries must be effectively insulated from the ambient while still permitting disassembly for replacement, repair and maintenance.

In conventional advertising plastic sign structures, the connection between the sign shell and the sign backing panel is effected by providing the peripheral edge of the shell with an outwardly projecting flange inserted in a groove of a metallic moulding, such as an extruded aluminum or stainless steel moulding bent to the peripheral contour of the shell, which is used as an intermediary member for mounting the shell on its backing panel. Shaping, bending and fastening such a metallic moulding around the periphery of the shell is a complicated, lengthy and tedious task requiring considerable skill on the part of the person effecting such an operation, especially when it is effected on shells representing individual letters of the alphabet, some of which are rather complex and may require sharp bends in the moulding which are not easily effected without providing cuts in the moulding material such as notches and the like, in view of the fact that the moulding strips are generally F-shaped, or the like, in cross section. Furthermore, in order to provide a weatherproof assembly of the shell and the backing panel, a multiplicity of gasket strips are required, such as for example one gasket strip between the shell flange surface and a surface of the moulding groove in which the flange is inserted and a gasket strip between the moulding surface and the edge surface of the backing panel at the location where the moulding is fastened to the backing panel.

In addition, it is often desirable to hide from sight the normally apparent rear surface of the backing panel and to shelter, in addition to hiding, the electrical equipment, brackets and the like fastened to the rear surface of the backing panel. Consequently, the metallic moulding is often made of a substantially wide strip such as to project a certain distance beyond the backing panel, preferably extending all the way to the supporting structure, such as to shield from view and from the weather, the electrical boxes, transformers, and mounting brackets of the sign structure. Using such a wide strip obviously complicates the problem involved in shaping, bending and fastening the strip about the periphery of the sign shell.

Another problem resulting from the use of metallic mouldings, especially when they are made of aluminum extrusions, is the relatively rapid deterioration of the surface finish due to oxidation and corrosion, and the poor surface adherence of most paint compositions to such metallic surfaces, particularly aluminum surfaces. In addition, the assembly of a plastic shell, backing panel and peripheral moulding is subject to considerable deterioration of the joints and sealed surfaces resulting from the collection of water and subsequent freezing and thawing of such water, and from continuous motion and flexing of the elements due to climatic and ambient temperature changes.

The present invention, by providing a deep drawn plastic shell having side faces or walls integrally shaped in two portions, one portion forming the side of the sign itself, and the other portion defining a skirt projecting beyond the backing panel, and by providing a step portion in the form of a contoured flange outwardly laterally projecting in a single plane and integrally formed with the side face and skirt portion of the shell, remedies the disadvantages of advertising sign structures according to the prior art. The assembly of the shell and of the backing panel of the invention is effected at the outwardly leterally extending flange portion of the shell. A simple strip gasket is used between the flange portion surface and the marginal surface of the backing panel, by being sandwiched therebetween and placed under compression, and the fastening of the shell onto the backing panel is effected by means of conventional fasteners such as screws and the like driven either through the laterally projecting flange portion of the shell or through the wall of the skirt portion proximate the ridge defined at the connection between said skirt portion and flange portion.

The skirt portion is not subject to surface corrosion and deterioration as is the case for metallic mouldings.

In addition, the skirt portion being an integral and continuous extension of the shell structure and sign surface can be painted, if so desired, either externally or internally to simulate a metallic moulding, or for any other desired esthetic effect. The paint may be chemically compounded such as to become part of the plastic surface with the result that the painted surface is not subject to the general deterioration which occurs on metallic strips. The range of color choice is substantially greater than the range of colors generally available for painting metal surfaces.

SUMMARY OF THE INVENTION

The present invention accomplishes the objects of providing an advertising sign structure consisting of two simple elements in assembly, one of such elements being a single-piece shell of deep drawn plastic material mounted over a backing panel having an outline corresponding to that of a mounting flange integrally formed on the side of the shell, and further including appropriate gasket and fastening means such as to form a free standing sign structure in the form of a complete sign or of a single letter element of a multi-letter sign ready for attachment to a superstructure. The invention permits to make advertising signs having any desired ornamental appearance without any structural or manufacturing limitations superimposed upon esthetic and ornamental considerations. The invention provides a sign structure which may be illuminated by means of a luminary disposed within the shell, which is self-contained, relatively light in weight, which may be manufactured at relatively low cost without the use of skilled labor, which is weatherproof, easy to install and easy to maintain and repair.

BRIEF DESCRIPTION OF THE DRAWINGS

The present invention will be best understood when the following description of the best mode contemplated for practicing the invention is read in conjunction with the attached drawing wherein.

DETAILED DESCRIPTION OF THE PREFERRED EMBODIMENT

Figure 1:
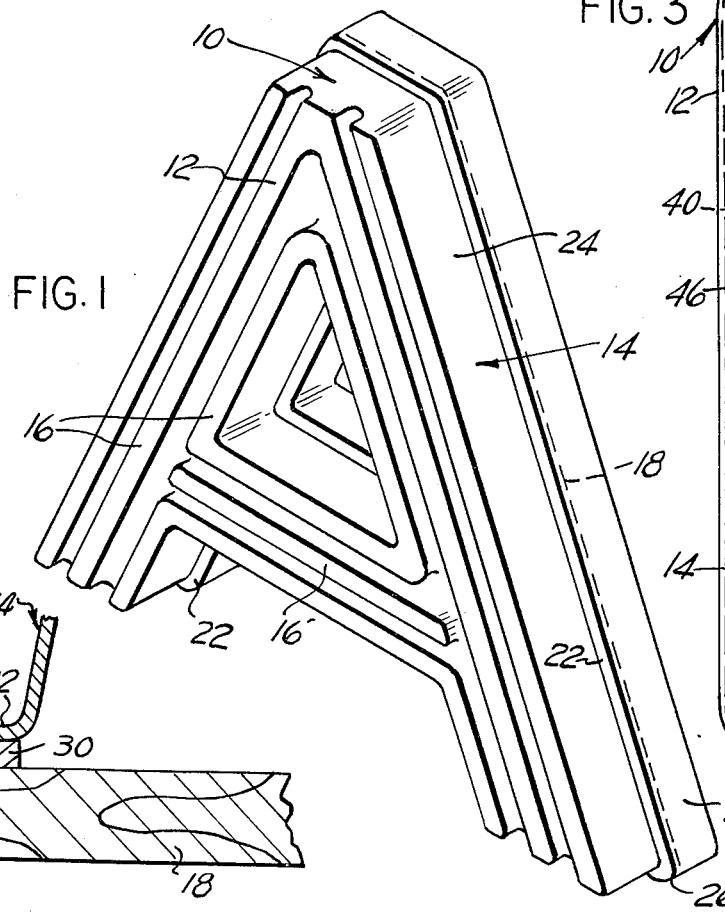
FIG. 1 is a self-contained free standing advertising sign structure according to the present invention, shown in perspective view.

Referring now to the drawing and more particularly to FIGS. 1–4 thereof, a free standing advertising sign structure according to the present invention consists of a complete sign comprising several characters such as letters and numerals, or alternately, consists of individual letter characters or the like which in use are mounted on a superstructure, such as a store front, in an appropriate order to form a name. In the example of the structure illustrated, a capital letter A is represented which is made principally of a single-piece deep drawn shell 10 of plastic material, having a bottom or front face wall 12 and side faces or walls 14. The front face 12 of the shell 10 has a plurality of ribs 16 which provide an added decorative effect, which increase the strength and rigidity of the shell and, in signs where the letters are made of translucent colorless or colored plastic with an appropriate luminary disposed in the interior of the shell for shining light through at least the front face surface of the shell, the ribs 16 may be arranged to provide a lens effect. The shell 10 is supported by and mounted over a backing panel 18 which may be made of any convenient material such as a porcelain enamel, sheet steel, or preferably as illustrated, an aluminum-clad plywood panel such as sold under the trademark "Plymetal" by Metal Wood Corporation of Chicago, Ill. The backing panel 18 is precut to an appropriate contour and dimension permitting the backing panel to be inserted into the shell 10, the shell 10 being provided for that purpose with a skirt portion 20 on its side faces 14, an outwardly laterally projecting flange 22 disposed in a single plane being formed integrally at the junction between the side portion 24 of the letter A of the sign shell 10 and the side skirt portion 20 thereof, a continuous peripheral ridge 26 being thus formed at the junction of the flange 22 and the skirt portion 20.

Figure 5:
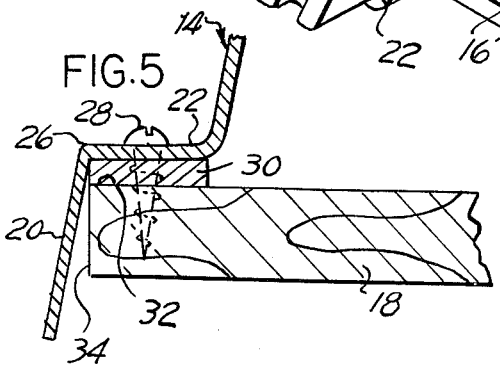
FIG. 5 is a partial transverse sectional view of a modification thereof shown at an enlarged scale.

The shell 10 and the backing plate 18 are assembled together about the flange 22 of the shell 10, as best shown at FIG. 5, by means of conventional fasteners such as screws 28 driven through the flange 22 and through a resilient gasket 30, made of rubber, elastomer, or any other convenient resilient material sandwiched between the inner surface of the flange 22 and the surface of the marginal portion 32 of the backing plate 18. The screws 28 are driven tight enough so as to slightly compress the gasket material with the result that once the shell 10 is mounted on the backing plate 18, the interior of the shell 10 is waterproof and dustproof. Alternatively, as shown at FIG. 4, the backing plate 18 and the shell 10 may be assembled together by means of screws 28 driven through the wall of the skirt portion 20 proximate the ridge 26, threaded into the edge surface 34 of the backing plate 18, a resilient gasket 30 being disposed between the surface of the flange 22 and the surface of the marginal portion 32 of the backing plate 18.

Figure 3:
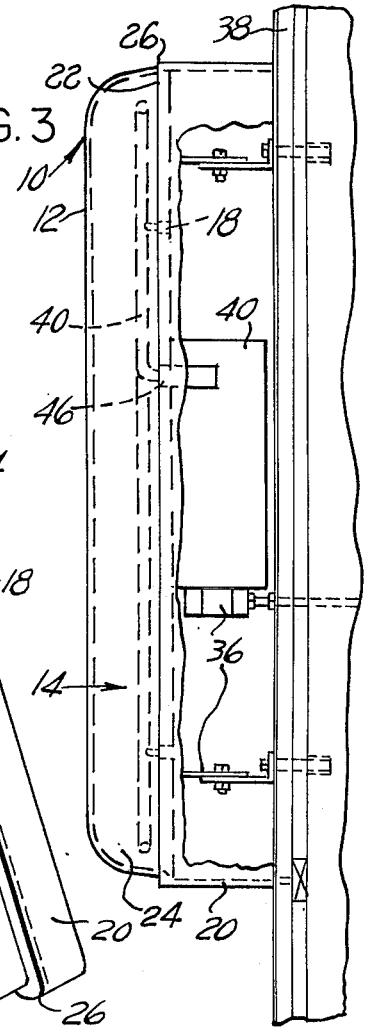
FIG. 3 is a side elevation thereof with portions removed to show the sign structure of the invention attached to a support structure.

The shell 10 is moulded from heated thermo-plastic sheet material over, for example, a wooden form, by conventional vacuum forming apparatus. Examples of thermal plastic sheet materials suitable for deep shell forming comprise acrylonitriles, butadienes, styrenes, cellulose acetate butyrate, polycarbonates, and various acrylic resins. The side skirt 20 of the shell 10 may be of any desired length such as being long enough at least to cover the edge surface 34 of the backing plate 18, or preferably, such as to be long enough, as shown at FIG. 3, to cover, shelter and remove from eyesight the brackets 36 or other attachment means provided for attaching the sign to a supporting structure such as a store front 38 or the like. Furthermore, in installations where the sign is illuminated by means of luminaries disposed inside of the shell 10 mounted on the face of the backing panel 18 nearly any portion of the electrical equipment supplying the luminaries such as connection boxes, transformers, and the like which may project on the back of the backing plate 18, as shown at 40 at FIGS. 3 and 4, are also hiden from view and sheltered from rain, snow or dust by the projecting skirt 20.

Figure 2:
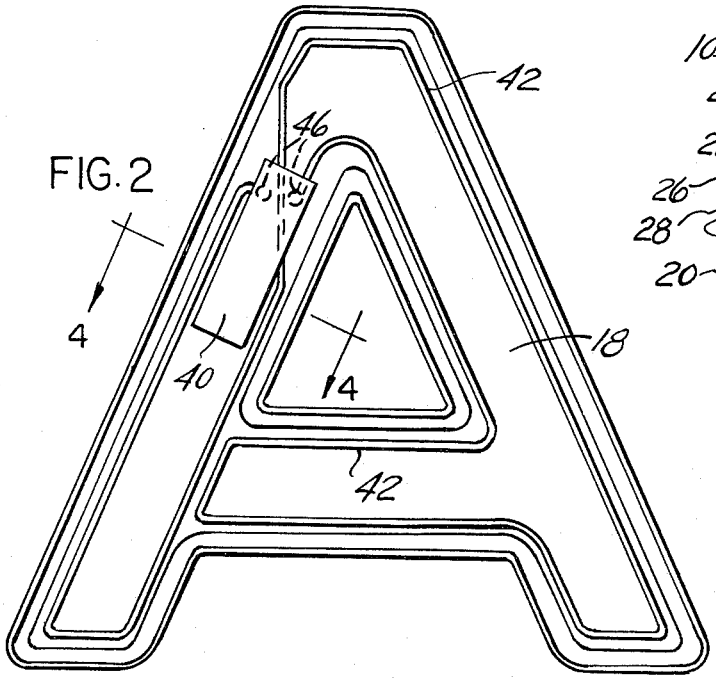
FIG. 2 is a plan elevation view thereof with the front face thereof removed to show the internal construction.
Figure 4:
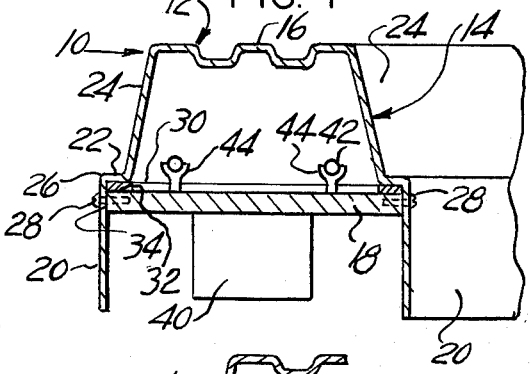
FIG. 4 is a transverse section thereof along line 4-4 of FIG. 2.

The luminary for illuminated signs consists preferably of a neon or other gas, or gases, electrofluorescent tubing shaped to an appropriate contour, as shown at 42 at FIGS. 2 and 4, supported from the inner side of the backing plate 18 by means of appropriate hangers 44 (FIG. 4). The ends of the fluorescent tubing 42 are provided with appropriate terminals connected to corresponding terminals 46 of the transformer 40, appropriately connected to the electrical main by way of an input line, not shown. The transformer and any other electrical connection boxes, are mounted flush with the front surface of the backing panel 18, the protective housing of the transformer 40 projecting from the rear surface of the backing panel 18, as shown at FIGS. 3 and 4.

The structure of the present invention, therefore, provides an advertising sign unit which is simple in construction and easy to manufacture and maintain and which is dust- and weatherproof. The structure of the invention requires only a simple weatherproofing gasket for assembly of the shell 10 to the backing plate 18, and the shell 10, if so desired, may be formed with an integrally formed skirt portion hiding from view and protecting from the inclemencies of the weather the sign supporting structure and any electrical equipment required in illuminated signs.

Figure 6:
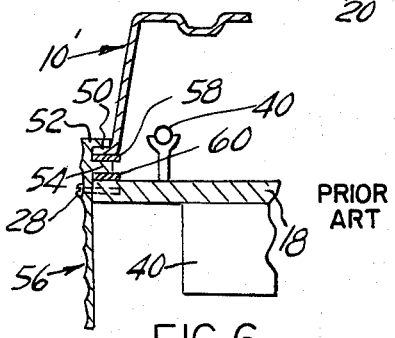
PRIOR ART FIG. 6
FIG. 6 is a view similar to FIG. 4, but illustrating the prior art.

The advantages procured by the structure of the present invention are readily apparent when such structure is compared to that of the prior art illustrated at FIG. 6. The shell 10' of an advertising sign structure according to the prior art is provided with an outwardly extending flange 50 insertable between the two parallel leg portions 52 and 54 of a generally F-shaped, in cross section, metallic moulding strip 56, made of aluminum or like material. The flange 50 of the shell 10' is frictionally engaged in the groove formed between the legs 52 and 54 of the moulding, a resilient gasket 58 being forceably engaged below the flange 50 to provide weatherproofing and for securing the shell 10' and the moulding strip 56 together. A second gasket element 60 is required between the leg portion 54 of the moulding strip 56 and the marginal surface portion of the backing plate 18, when the sub-assembly consisting of the shell 10' and the moulding strip 56 is mounted upon the backing panel 18 by means of the screws 28 as shown.

Having thus described the invention by way of typical structural examples thereof, modifications thereof will be apparent to those skilled in the art, what is claimed as novel is as follows:

1. An advertising sign structure comprising a single-piece shaped shell of deep drawn plastic material having front faces and side faces, said side faces having an integral continuous flange portion extending peripherally in a single plane outwardly from said side faces and an integrally formed skirt portion forming a continuous ridge with the outer end of said flange portion, a backing panel having a front surface, a rear surface and a contoured edge for fitting within said skirt portion with a marginal portion of the front surface of said panel disposed within said shell in close proximity with said continuous flange portion, a resilient gasket sandwiched between said flange portion and said front surface marginal portion, fastener means for affixing said shell to said backing panel while maintaining said gasket under compression between said flange portion and said front surface marginal portion, and support means extending between said backing panel and a supporting structure for attaching said backing panel to said supporting structure, wherein said shell skirt portion extends proximate said supporting structure and forms a protective covering for said support means and components mounted on the rear surface of said backing panel.

2. The advertising sign structure of claim 1 wherein said shell is made of translucent plastic material and further comprising a luminary mounted on the front surface of said backing panel within said shell.

3. The advertising sign structure of claim 2 wherein said luminary is a contoured fluorescent light tube.

4. The advertising sign structure of claim 2 wherein said fluoroescent light tube is supplied in electricity through a transformer and at least part of said transformer projects from the rear surface of said backing panel.

5. The advertising sign structure of claim 1 wherein said fastening means comprises a plurality of screws driven through said flange portion, said gasket and said front surface marginal portion.

6. The advertising sign structure of claim 1 wherein said fastening means comprises a plurality of screws driven through said skirt portion proximate said flange portion and through the edge portion of said backing panel.

* * * * *